United States Patent [19]

Masanobu

[11] Patent Number: 4,661,693

[45] Date of Patent: Apr. 28, 1987

[54] PHOTOMULTIPLIER CONTROL CIRCUIT HAVING A COMPENSATING LIGHT SOURCE

[75] Inventor: Kazunori Masanobu, Hachiohji, Japan

[73] Assignee: Kabushiki Kaisha Toshiba, Kawasaki, Japan

[21] Appl. No.: 717,819

[22] Filed: Mar. 29, 1985

[30] Foreign Application Priority Data

Mar. 31, 1984 [JP] Japan ..... 59-63633
Mar. 31, 1984 [JP] Japan ..... 59-63657

[51] Int. Cl.[4] ..... H01J 40/14
[52] U.S. Cl. ..... 250/207; 313/533
[58] Field of Search ..... 250/207; 313/532, 533, 313/534, 535, 536

[56] References Cited

U.S. PATENT DOCUMENTS 3,611,042 10/1971 Boronkay ..... 250/207
4,310,243 1/1982 Brown et al. ..... 250/207
4,563,707 1/1986 Kishida ..... 250/207

OTHER PUBLICATIONS

Radioisotopes, vol. 28, No. 7, Jul. 1979, Shigeru Kataoka et al. (pertinent portions translated).

*Primary Examiner*—David C. Nelms
*Assistant Examiner*—William L. Oen
*Attorney, Agent, or Firm*—Oblon, Fisher, Spivak, McClelland, & Maier

[57] ABSTRACT

A photomultiplier control circuit includes a circuit for receiving an output signal of a photomultiplier, which detects a light to be measured and converts the detected light to an electric signal in order to generate an output depending on a level of the light to be measured. A light source is used for applying a compensating light to the photomultiplier and a circuit is provided for detecting an average anode current of the photomultiplier. A comparison circuit compares outputs of both circuits and generates the resulting difference output. A control circuit controls the intensity of a light emitted from the light source based on the difference output. The circuit is capable of stabilizing gain fluctuations of a photomultiplier when the incident light is input thereto in the form of a direct current, and also capable of maintaining the accuracy of a photomultiplier when it is employed in measuring tools, etc.

8 Claims, 5 Drawing Figures

PHOTOMULTIPLIER CONTROL CIRCUIT HAVING A COMPENSATING LIGHT SOURCE

BACKGROUND OF THE INVENTION

1. Field of the Invention

The present invention relates to a measuring circuit using a photomultiplier, and more particularly to a photomultiplier control circuit for stabilizing the gain of the photomultiplier.

2. Description of Related Art

A photomultiplier, in which a cathode receives an incident light to convert it to electrons which are amplified by a multiplicity of dynodes and then taken out from an anode (plate) in the form of a current or electric charges, is extensively utilized in measuring a very small amount of light because it has a high degree of amplification.

When the output of a photomultiplier is an analog current, the gain of the photomultiplier is varied with abrupt changes in the level of the incident light upon the photomultiplier, as shown in FIG. 1. In other words, the gain is lowered when the incident light is at a high level, while the gain is increased when the incident light is at a low level. This is supposed to be mainly attributable to a fatigue and restoration phenomenon of dynodes, which is also referred to as a phenomenon of hysterisis because the current gain is determined by the previous operation hysterisis.

When attempting to precisely measure the incident light, such fluctuations in the gain can not be ignored. There is a method capable of compensating the gain of the photomultiplier when the incident light can be chopped into the form of light pulses, but it is impossible to compensate the gain when the incident light is continuously input in the form of a direct current. Therefore, in a thickness gauge of the type wherein radiation of a certain dosage is emitted from a radiation source and wherein the part of the radiation having passed an inspected substance is converted to a light by a scintilator, for example, which light is detected by a photomultiplier to measure a thickness of the inspected substance, the foregoing gain fluctuations give rise to a substantial problem in an attempt to obtain a high accuracy of measurement. This problem occurs when the inspected object is a plate material flowing over the manufacturing line and when plates having a thickness different from that of the previous ones begin to flow over the line.

SUMMARY OF THE INVENTION

Accordingly, an object of this invention is to provide a novel photomultiplier control circuit which is capable of stabilizing fluctuations in the gain of a photomultiplier when the incident light is input thereto in the form of a direct current, and which is capable of maintaining the accuracy of the photomultiplier when it is employed in measuring tools, etc.

To achieve the above object, the present invention is characterized by a light source which is provided for applying a compensating light to a photomultiplier and the input light to the photomultiplier is monitored with an output from the photomultiplier to vary the intensity of light emitted from the light source depending on the magnitude of the input light so that an average anode current output from the photomultiplier is held constant, thereby preventing fatigue and the restoration phenomenon of dynodes in the photomultiplier to thereby stabilize its gain.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PRFERRED EMBODIMENTS

Figure 1:
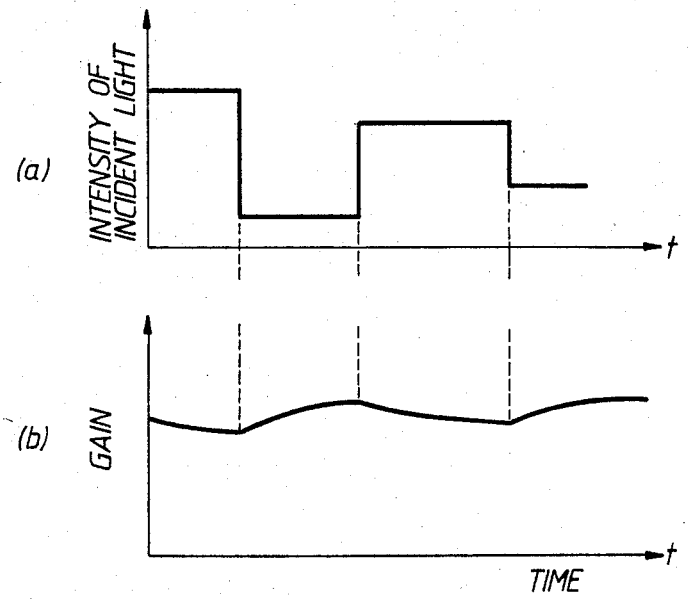
FIG. 1 is a graph showing the relationship between changes in the intensity of incident light upon a photomultiplier and the resulting fluctuations in the gain thereof.
Figure 2:
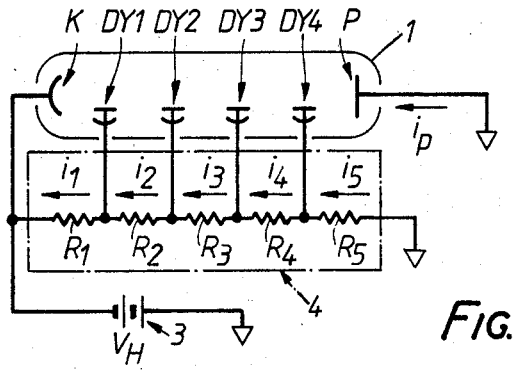
FIG. 2 is a view for explaining principles of the present invention.

Referring now to the drawings, FIG. 2 illustrates a typical circuit in which a photomultiplier is employed, and it is herein presented for explaining operational principles of the present invention.

Referring to FIG. 2, designated at reference numeral 1 is a photomultiplier having a cathode (light receiving surface) K which is optically coupled to both a measured light and a compensating light so as to receive them. The cathode K of the photomultiplier 1 is connected to a DC high voltage power supply 3, and a breeder resistor 4 comprising individual resistors R1–R5 produces divided voltage which are respectively applied to dynodes DY1–DY4 (herein composed of four stages, although generally, approximately ten-staged dynodes are employed).

Figure 3:
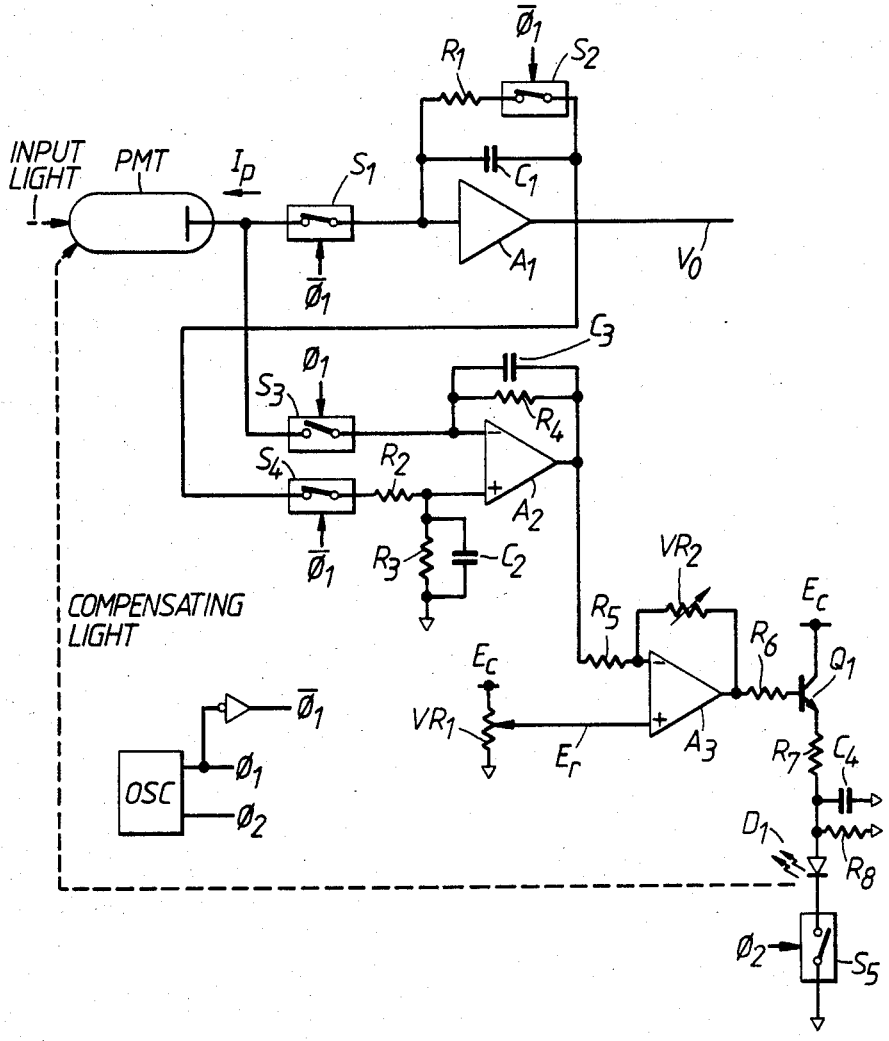
FIG. 3 is a circuit diagram showing one embodiment of the present invention.

FIG. 3 illustrates a block diagram of one embodiment of the present invention. Referring to the figure, designated at PMT is a photomultiplier having an anode which is connected to one end terminal of each of two switches $S_1$ and $S_3$. The photomultiplier PMT in FIG. 3 is depicted with the breeder resistor, etc. in FIG. 2 omitted. Normally, the switch $S_1$ is closed and the switch $S_3$ is opened. The other end terminal of the switch $S_1$ is connected to a typical current/voltage amplifier $A_1$ with a parallel circuit comprising a resistor $R_1$ and a capacitor $C_1$ connected between an input terminal and an output terminal thereof. Further, a switch $S_2$ is serially connected to the resistor $R_1$. This switch $S_2$ is normally closed and then opened in a hold state.

On the other hand, for detecting an anode current Ip of the photomultiplier PMT, the other end terminal of the switch $S_3$ is connected to an inverted input terminal of an operational amplifier $A_2$ with a parallel circuit comprising a resistor $R_4$ and a capacitor $C_3$ connected between the inverted input terminal and an output terminal thereof. A non-inverted input terminal of the operational amplifier $A_2$ is connected to the output side of the amplifier $A_1$ through a resistor $R_2$ and a switch $S_4$. Furthermore, a parallel circuit comprising a resistor $R_3$ and a capacitor $C_2$ is connected between the non-inverted input terminal of the operational amplifier $A_2$ and the ground. The switches $S_3$ and $S_4$ are actuated in complementary relation; namely, $S_4$ is closed while measuring the input light and $S_3$ is closed while turning on the compensating light. $A_3$ designates an operational amplifier which has a variable resistor $VR_2$ for adjusting the gain connected between an inverted terminal and an output terminal thereof, the inverted input terminal being connected to receive an output of the operational amplifier $A_2$ through an input resistor $R_5$. Further, an output from a movable terminal of a variable resistor $VR_1$ for dividing DC power supply voltage Ec is applied as setting voltage Er to a non-inverted input terminal of the operational amplifier $A_3$, whereby the operational amplifier $A_3$ functions as an amplifier for comparing the setting voltage Er and the average anode current (i.e., output of the amplifier $A_2$). The output of the amplifer $A_3$ is applied to the base of a drive transistor $Q_1$ through an output resistor $R_6$ so as to operate the transistor $Q_1$. The transistor $Q_1$ supplies an output to an LED (light emitting diode) $D_1$ for generating compensating light through a resistor $R_7$ connected to the emitter thereof in order to turn on the LED $D_1$. $S_5$ designates a switch provided on the cathode side of the LED $D_1$. The switches $S_1$–$S_5$ are controlled with control signals $\phi_1$, $\phi_2$, $\bar{\phi}_1$ and $\bar{\phi}_2$. The switch $S_5$ is employed to control a turn on time of the LED $D_1$, and the control signals $\phi_1$, $\phi_2$ are produced from an oscillation circuit OSC composed of well-known components.

Furthermore, a parallel circuit, comprising a capacitor $C_4$ and a resistor $R_8$, which is connected between an anode of the LED $D_1$ and ground, serves as a filter.

Figure 4:
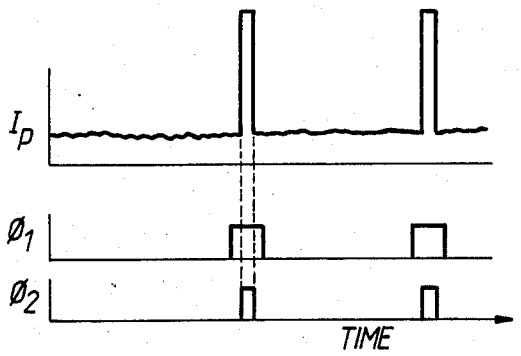
FIG. 4 is a time chart showing operation of the circuit of FIG. 3.

Operation of this embodiment thus constructed will be described below. First, timing of the switch control signals $\phi_1$, $\phi_2$ will be described by referring to FIG. 4. These controls signals $\phi_1$, $\phi_2$ are turned on with certain cycles and controlled so that $\phi_2$ comes within a turn-on period of $\phi_1$. The compensating light is turned on in synchronous relation with $\phi_1$. In a typical example, $\phi_1$, $\phi_2$ have a cycle of 0.1 sec, a turn-on time of $\phi_1$ is 2 ms, and a turn-on time of $\phi_2$ is 1 ms.

Operation of the circuit constructed as shown in FIG. 3 will now be described. During the time when the compensating light is turned off, i.e., when the input light is measured, $\phi_1$ is turned off so that the switches $S_1$, $S_2$ and $S_4$ are closed. In this state, an output current of the photomultiplier PMT enters the amplifier $A_1$ which produces voltage of $-Ip.R_1$ on the output side Vo thereof. This voltage is applied to the amplifier $A_2$ for detecting the photomultiplier's output current.

Next, when $\phi_1$ is turned on, only the switch $S_3$ is closed so that the photomultiplier's output current enters the amplifier $A_2$. On the other hand, the amplifier $A_1$ is opened on the input side thereof and the feedback resistor $R_1$ also comes into an open state, thus causing amplifier $A_1$ to function as a hold amplifier. As result, the amplifier $A_1$ holds the voltage produced at the time immediately before opening produced at the time immediately before opening of both the switches $S_1$ and $S_2$.

In the above operations, the output Vo represents a signal corresponding to the output of the photomultiplier without any compensating light, while the output of the amplifier $A_2$ corresponds to the actual average anode current of the photomultiplier including the compensating light.

Meanwhile, the output of the amplifier $A_2$ is compared with the setting voltage Er and the resulting difference output is applied to the transistor $Q_1$ so as to control same. Herein, the setting voltage Er is appropriately preset by use of the setting unit $VR_1$. The voltage issued from the transistor $Q_1$ thus controlled with the output of the amplifier $A_2$ is applied to the LED $D_1$ through a resistor $R_7$ to thereby illuminate the LED $D_1$ in the intensity of light corresponding to the above output voltage, the illuminated light being applied as a compensating light to the photomultiplier PMT. In this connection, the LED $D_1$ is turned on and off by the switch $S_5$ at timing of the signal $\phi_2$ output from the oscillation circuit OSC, whereby the LED $D_1$ can be driven with the current reaching a predetermined peak at timing of $\phi_2$.

The time constant of the amplifier $A_2$ for detecting the photomultiplier's anode current is selected to be about 10 seconds. Namely, $R_3.C_2=R_4.C_3=10$ sec. The description of the oscillation circuit OSC for generating th control signals $\phi_1$, $\phi_2$ will be omitted because it is well known in the art. Besides, the variable resistor $VR_2$ of the amplifier $A_3$ is intended to adjust the gain of a control loop and regulated depending on a variation rate of the input light to be measured and the accuracy of the control system.

In this way, since the average anode current of the photomultiplier can be controlled so that it is constant, the average anode current will not be varied even with changes in the intensity of input light (or measured light), thus making it possible to perform a high accuracy measurement by preventing fluctuations in the gain of photomultiplier, particularly, a fatigue and restoration phenomenon thereof. Other advantages include the fact that on/off timing as well as the duty cycle of the compensating light has enough freedom to be optionally determined in accordance with the measuring conditions (such as the measuring cycle) because no particular limitation is exerted thereon, and because the control system of the anode current will not be affected even with changes in the high voltage applied to the photomultiplier.

Although in the foregoing embodiment the LED is employed as a source for the compensating light, any other light source such as an incandescent electric lamp may be used instead. Also, the circuit of the foregoing embodiment can be modified within a range meeting the essential function of the present invention so that the average anode current of a photomultiplier is detected and compared with the reference to radiate the compensating light for a predetermined period in accordance with the resulting difference. Furthermore, the switch $S_2$ serially connected to the feedback resistor $R_1$ of the amplifier $A_1$ may be dispensed with. In this case, however, the output voltage Vo becomes a value smaller than $Ip.R1_1$.

According to this embodiment, since the compensating light is applied from a light source to the photomultiplier and the input light to the photomultiplier is sampled to vary the intensity of compensating light emitted from the light source depending on the magnitude of input light so that the average current output from the photomultiplier is held constant, then a photomultiplier control circuit is used which permits highly accurate measurement even in case of inspecting objects greatly different in depth from each other while being passed along a manufacturing (or inspection) line when the present circuit is employed in a thickness gauge, etc., because a fatigue and restoration phenomenon of dynodes is prevented.

Figure 5:
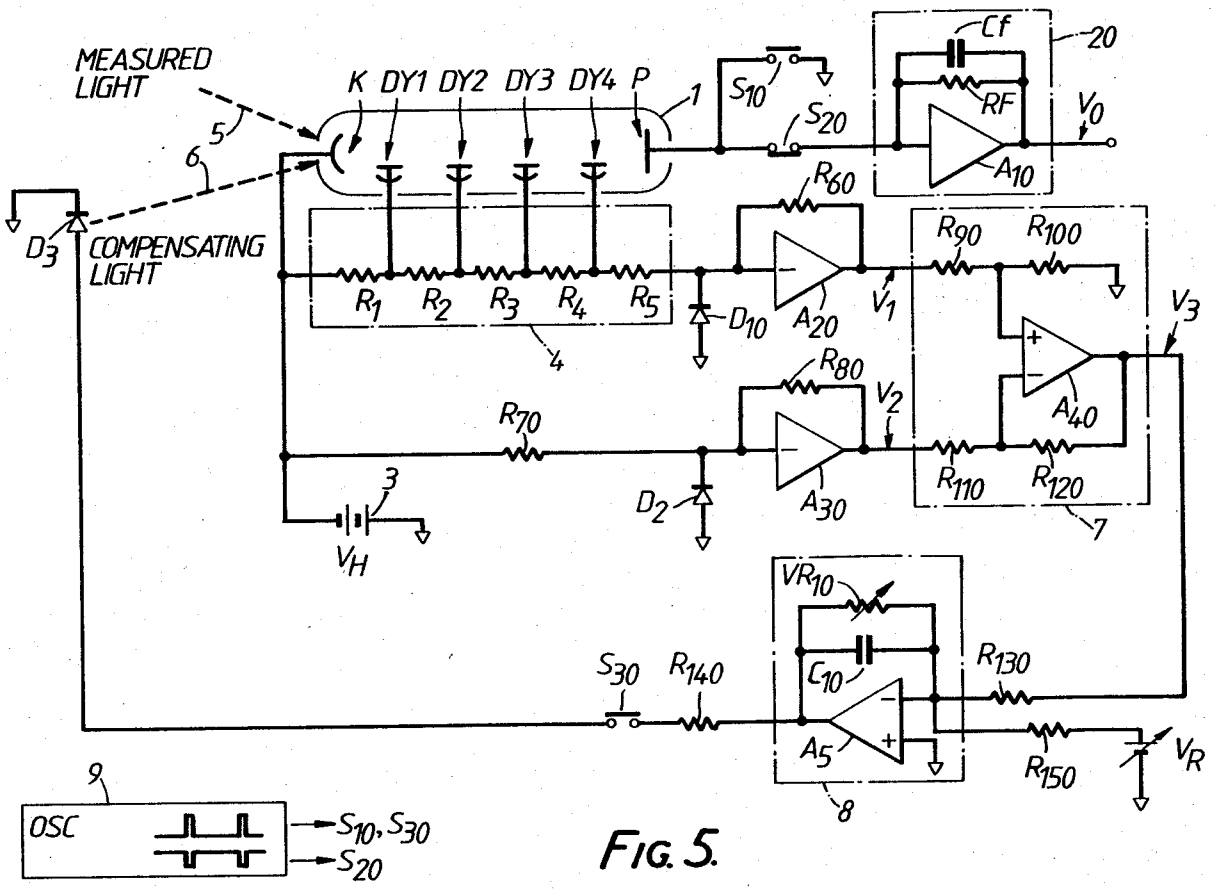
FIG. 5 is a circuit diagram showing another embodiment of the present invention.

FIG. 5 illustrates another embodiment of the present invention in which the photomultiplier 1 of FIG. 2 is employed. The photomultiplier 1 has a cathode (light receiving surface) K which is optically coupled so as to receive both a measured light and a compensating light. The cathode K of the photomultiplier 1 is connected to a DC high voltage power supply 3, and different divided voltages are produced with a breeder resistor 4 comprising individual resistors R1–R5 and are respectively supplied to dynodes DY1–DY4 (herein composed of four stages, although approximately ten-staged dynodes are generally used). Connected to the ground side of the breeder resistor 4 is a current detecting amplifier comprising an amplifier A20 which includes a negative feedback resistor R60 connected between its input and output, so that the amplifier A20 outputs voltage V1 in proportion to the current flowing through the resistor R5 of the above breeder resistor 4.

On the other hand, the negative polarity side of the high voltage power supply 3 is connected to another resistor R70 which in turn is connected to an amplifier A30 including a negative feedback resistor R80 connected between its input and output, whereby the current flowing through the resistor R70 is converted to voltage V2 by the amplifier A30. Designated at 7 is a differential amplifier so arranged that the voltage dividedly produced from the intermediate point of resistors R90 and R1OO, serially connected between the amplifier A20 and the ground, is connected a noninverted input terminal of an operational amplifier A30, the output V2 of the amplifier A30 is applied to an inverted input terminal of the operational amplifier A40 through an input resistor R11O, and a negative feedback resistor R120 is connected between the inverted input terminal and an output terminal of the operational amplifier A40. This differential amplifier 7 outputs difference voltage V3 between the detection voltages V1 and V2. Designated at 8 is a control amplifier so connected that the difference voltage V3 is amplified by the control amplifier 8 and then supplied through a serial circuit comprising a resistor R140 and a switch S30 to drive a light emitting diode D3 for radiating the compensating light 6 to the photomultiplier 1. The control amplifier 8 is so arranged that a parallel circuit comprising a capacitor C10 and a variable resistor VR10 is connected between an inverted input terminal and an output terminal of an operational amplifier A50, a serial circuit comprising a resistor R150 and a variable DC power supply VR is connected between the inverted input terminal thereof and the ground, and a non-inverted input terminal thereof is grounded. Designated at R130 is an input resistor connected between the inverted input terminal of the operational amplifier A50 and the output terminal of the amplifier 7.

Meanwhile, an output of the photomultiplier 1 (or output from the plate side) is connected through a switch S20 to a current detecting amplifier 20 comprising an operational amplifier A10, a capacitor Cf and a resistor Rf, and also grounded through a switch S10 which is actuated in reverse relation to the switch S20. The switches S10, S20 and S30 undergo on/off control with timing signals issued from a timing control section 9. Herein, S10, S30 and S20 are controlled to repeatedly turn of and off in reverse timing relation with each other.

The variable DC power supply VR is a reference power supply for determining the average anode current of the photomultiplier 1, and D1, D2 designate input protecting diodes for the amplifiers A20, A30, respectively.

Operation of this embodiment thus constructed will be described below.

First, operational principles of this embodiment will be described by referring to FIG. 2. It is now assumed that current i1–i5 flow through the resistors R1–R5 in association with the dynodes DY1–DY4, respectively. Then, it is intended to control a photomultiplier's anode current ip by detecting the current i5 which is largely related with the anode current, and based on the detected value. Therefore, the relationship between ip and i5 is calculated as follows.

$$i4 = i5 + ip\left(1 - \frac{1}{\alpha}\right) \tag{1}$$

(where $\alpha$ is an amplification factor for each stage of dynode)

$$\begin{aligned} i3 &= i4 + \frac{iP}{\alpha}\left(1 - \frac{1}{\alpha}\right) \\ &= i5 + ip\left(1 - \frac{1}{\alpha}\right)\left(1 + \frac{1}{\alpha}\right) \end{aligned} \tag{2}$$

$$\begin{aligned} i2 &= 13 + \frac{iP}{\alpha^2}\left(1 - \frac{1}{\alpha}\right) \\ &= i5 + ip\left(1 - \frac{1}{\alpha}\right)\left(1 + \frac{1}{\alpha} + \frac{1}{\alpha^2}\right) \end{aligned} \tag{3}$$

$$\begin{aligned} i1 &= i2 + \frac{iP}{\alpha^3}\left(1 - \frac{1}{\alpha}\right) \\ &= i5 + ip\left(1 - \frac{1}{\alpha}\right)\left(1 + \frac{1}{\alpha} + \frac{1}{\alpha^2} + \frac{1}{\alpha^3}\right) \end{aligned} \tag{4}$$

The voltage of the high voltage power supply 3 is assumed to be $V_H$ which is represented as follow.

$$V_H = i1 \cdot R1 + i2 \cdot R2 + i3 \cdot R3 + i4 \cdot R4 + i5 \cdot R5 \tag{5}$$

$$\begin{aligned} &= \left\{ i5 + ip\left(1 - \frac{1}{\alpha}\right)\left(1 + \frac{1}{\alpha} + \frac{1}{\alpha^2} + \frac{1}{\alpha^3}\right)\right\} R1 + \\ &\quad \left\{ i5 + ip\left(1 - \frac{1}{\alpha}\right)\left(1 + \frac{1}{\alpha} + \frac{1}{\alpha^2}\right)\right\} R2 + \\ &\quad \left\{ i5 + ip\left(1 - \frac{1}{\alpha}\right)\left(1 + \frac{1}{\alpha}\right)\right\} R3 + \\ &\quad \left\{ i5 + ip\left(1 - \frac{1}{\alpha}\right)\right\} R4 + i5 \cdot R5 \end{aligned} \tag{6}$$

$$\begin{aligned} &= i5(R1 + R2 + R3 + R4 + R5) + ip\left(1 - \frac{1}{\alpha}\right) \cdot \\ &\quad \left\{\left(1 + \frac{1}{\alpha} + \frac{1}{\alpha^2} + \frac{1}{\alpha^3}\right) R1 + \left(1 + \frac{1}{\alpha} + \frac{1}{\alpha^2}\right) R2 + \right. \\ &\quad \left. \left(1 + \frac{1}{\alpha}\right) R3 + R4 \right\} \end{aligned} \tag{7}$$

Assuming that R1–R5 and $\alpha$ are constant:

$$V_H = i5 \cdot A + ip \cdot B \quad \ldots (8)$$

where A and B are as follows:

$$A = R1 + R2 + R3 + R4 + R5 \quad (9)$$

$$B = \left(1 - \frac{1}{\alpha}\right)\left(1 + \frac{1}{\alpha} + \frac{1}{\alpha^2} + \frac{1}{\alpha^3}\right) R1 + \left(1 + \frac{1}{\alpha} + \frac{1}{\alpha^2}\right) R2 + \left(1 + \frac{1}{\alpha}\right) R3 + R4 \quad (10)$$

$$\therefore ip = \frac{1}{B}(V_H - A \cdot i5) \quad (11)$$

Thus, with $V_H$ assumed to be constant, ip can be uniquely determined by presupposing i5. In many cases, however, the high voltage $V_H$ of photomultiplier is varied with changes in sensitivity of the photomultiplier and upon exchange thereof. Accordingly, the influence of $V_H$ needs to be avoided in order to detect the anode current ip.

More specifically, the influence of $V_H$ can be eliminated by subtracting $V_H/B$ from the equation (11).

$$ip' = ip - \frac{V_H}{B} \quad (12)$$

$$\therefore ip' = \frac{1}{B} \cdot A \cdot i5 \quad (13)$$

From the above, the anode current of photomultiplier can be seen by detecting the breeder current i5 in the circuit of FIG. 2 and then subtracting $V_H/B$ therefrom.

Operation of the embodiment shown in FIG. 5 will be described below.

The switches S10, S20 and S30 are actuated with the timing signals output from the timing control section 9 in reversed relation with each other in such a manner that the switches SlO, S30 and S20 are turned on and off complementarily. In this embodiment, a turn-on time of S10, S30 is set equal to 1 ms and a turn-off time thereof is set equal to 100 ms. Thus, it is understood that turn-on/off times of the switch S20 are reversed as compared with those of the switches S10, S30. It is also to be noted that the on/off cycle and the duty cycle undergo no particular restriction within a range which is determined based upon a temporal speed of gain fluctuations of photomultiplier, the time constant of the measuring system, the intensity of the compensating light 6 as well as the maximum anode current of photomultiplier.

Determination of the measured light 5 will now be described. In this mode, only the switch S20 is closed and the switches S10, S30 are opened. Accordingly, the compensating light 6 is off, while only the measured light 5 enters the photomultiplier 1 to be amplified and then introduced from its anode through the switch S20 to the output amplifier 20, where it is converted to voltage to thereby provide the measurement output Vo.

There will now be described incident timing of the compensating light 6. In this mode, the switches S10, S30 are closed and the switch S20 is opened. Accordingly, in the period of this mode, the output current from the photomultiplier 1 will not enter the amplifier 20.

On the other hand, the output of the control amplifier 8 is applied to the light emitting diode D3 upon closing of the switch S30, so that the light emitting diode D3 emits a light of the intensity corresponding to the thus-applied voltage, thus causing the emitted light to be applied as a compensating light 6 to the photomultiplier 1. Thus, both the compensating light 6 and the measured light 5 enter the photomultiplier 1 to be amplified and then output therefrom in the form of a current signal. This current signal flows to the ground through the switch S10 and will not enter the amplifier 20. At this time, the intensity (brightness) of compensating light is controlled to maintain the average anode current of the photomultiplier constant by adjusting the variable resistor VR10 to control the gain of the control amplifier 8.

Meanwhile, the detecting system for the photomultiplier's anode current functions at all times irrespective of operation of the switches S10–S30. More specifically, the output V1 of the amplifier A20 constituting the detection system is expressed from the equation (11) as follows:

$$V1 = i5 \cdot R6 = \frac{R6}{A}(V_H - B \cdot ip) \quad (14)$$

And the output V2 of the amplifier A30 for detecting high voltage is expressed as follows:

$$V2 = \frac{R8}{R7} \cdot V_H \quad (15)$$

Accordingly, the output voltage V3 of the differential amplifier 7 is expressed as follows with an assumption of R9=R10=R11=R12:

$$\begin{aligned} V3 &= V1 - V2 \quad (16) \\ &= \frac{R6}{A}(V_H - B \cdot ip) - \frac{R8}{R7} \cdot V_H \\ &= \left(\frac{R6}{A} - \frac{R8}{R7}\right) \cdot V_H - \frac{R6 \cdot B}{A} \cdot ip \end{aligned}$$

By selecting the constants to meet R6/A=R8/R7:

$$V3 = \frac{R6 \cdot B}{A} \cdot ip \quad (17)$$

Thus, the output voltage V3 of the differential amplifier 7 has a value proportional to the anode current of the photomultiplier. The output voltage V3 is equal to the difference between the output of the amplifier A30 and the setting voltage V2 is amplified by the control amplifier 8 to illuminate the light emitting diode D3. The variable resistor VRlO, for adjusting the gain of the control amplifier 8, is set based on the degree of stabilization and accuracy required for control of the photomultiplier's anode current control. The time constant of the amplifier 8 is a parameter which determines an averaging time of the average anode current of the photomultiplier, and it is selected depending on the degree of stabilization (versus time) of the photomultiplier and temporal fluctuations of the measured light 5.

As a result, the compensating light is adjusted to the intensity necessary for keeping the average anode current of the photomultiplier 1 constant.

In this manner, since the average anode current is controlled to be constant with the aid of the compensating light, the average anode current remains unchanged even with changes in the measured light, whereby the photomultiplier undergoes very small gain fluctuations and measurement can be performed with high accuracy. Also, the high degree of stabilization is obtainable by using a relatively simple circuit. In particular, as compared with a system of the type that wherein a special reference light is prepared to detect gain fluctuations and the high voltage applied to a photomultiplier is controlled on the basis of the detected result, the number of parts used is decreased by a factor of 5-10. Further, the present invention includes a circuit for compensating fluctuations in the high voltage such that the output of the high voltage power supply 3 is detected by the amplifier A30 for detecting fluctuations in the high voltage and then applied to the differential amplifier 7, whereby the the average anode current remains unchanged even with changes in the high voltage applied to the photomultiplier, thus making it possible to remarkably improve the reliability of a measuring device. There can be also obtained the advantage of facilitating design of the circuit because fluctuations in on/-off timing and duty of the compensating light will not essentially affect either the output voltage Vo corresponding to the measured light or the voltages V1, V3 in the control system.

The present invention is not limited to the embodiments as mentioned above and illustrated, and can be practiced with appropriate variations without departing the essence and scope of the invention. For example, although in the foregoing embodiments the light emitting diode was used as a compensating light source by way of example, any other light source such as an incandescent electric lamp may be employed instead. The differential amplifier 7 and the control amplifier 8 can be constructed into an integral form. It is also possible that the current detecting amplifier A30 can be dispensed with and the current can be directly detected by the differential amplifier 7.

As mentioned above, since the intensity of compensating light is controlled depending on the anode current so that the average anode current is held constant even with changes in the intensity of incident light upon the photomultiplier and in the high voltage applied thereto, there can be proposed a photomultiplier stabilizing circuit which can ensure a stable gain, which will not be influenced by a fatigue and restoration phenomenon of dynodes, and which permits high-stable, high-accurate measurement in a measuring device using a photomultiplier.

What is claimed as new and desired to be secured by Letters Patent of the United States is:

1. A photomultiplier control circuit comprising:

a photomultiplier which detects an incident light and converts the detected light to a first current electrical signal in order to generate an output depending on the level of said incident light;

a first circuit means for receiving said first current electrical signal from said photomultiplier for changing said first current electrical signal into a voltage electrical signal wherein said first circuit means outputs a voltage electrical signal representative of said level of said incident light during a first time period, and wherein said first circuit means holds the voltage produced at the time immediately before ending said first time period and outputs said voltage as said votlage electrical signal during a second time period;

a light source for applying a compensating light to said photomultiplier;

a second circuit means for detecting and outputting an average anode current of said photomultiplier;

a third circuit means for comparing the output of said second circuit means with a predetermined setting voltage and for generating an output which corresponds to the difference between said output of said second circuit means and said predetermined setting votlage; and a fourth circuit means for controlling the intensity of said compensating light emitted from said light source during third time period which is shorter than said second time period based on the output of said third circuit means.

2. A photomultiplier control circuit comprising:

a photomultiplier having individual dynodes and a voltage divider breeder resistor whereby high voltage is applied to individual dynodes through said voltage dividing breeder resistor wherein said photomultiplier detects a light to be measured and converts the detected light to an electrical signal;

a first circuit means for detecting a current produced by said breeder resistor of sid photomultipliers;

a second circuit means for detecting said high voltage;

a differential circuit means for detecting a different output between the outputs of both said first and said second circuit;

a light source for applying a compensating light to said photomultiplier;

a reference signal generating circuit for determining an average anode current; and an amplifier circuit means for amplifying an addition output of the output from said reference signal generating circuit and the output from said differential circuit and for applying the amplified addition output to said light source.

3. The circuit according to claim 1 wherein said first circuit means includes a first amplifier means and a first switch means.

4. The circuit according to claim 3 wherein said first amplifier means includes an amplifier and a parallel circuit including a first resistor and a first capacitor connected between the input and output of said amplifier and wherein said parallel circuit further includes a second switch connected in series with said first resistor.

5. The circuit according to claim 1 wherein said second circuit means includes a third and fourth switch means.

6. The circuit according to claim 5 wherein said third circuit means includes a second amplifier means wherein said second amplifier means has its inverted input connected to the output of said second circuit means and wherein the other input of said second amplifier means is connected to said predetermined voltage in order to provide said difference voltage.

7. The circuit according to claim 6 wherein said fourth circuit means includes a third amplifier means which receives on one input the output of said third circuit means and on the other input the output of a reference voltage and wherein said fourth circuit means further includes a fifth switch means.

8. The circuit according to claim 7 wherein said third and fourth switch means operate complementary to each other and wherein said fifth switch means is in a closed state only during a portion of the time period that said third switch means is in a closed state.

* * * * *